United States Patent [19]

Maes et al.

[11] 4,159,904

[45] Jul. 3, 1979

[54] PROCESS FOR EXTRACTING BISMUTH FROM A BISMUTH-BEARING MATERIAL

[75] Inventors: Robert H. Maes, Hove; Luc M. Fontainas, Antwerp, both of Belgium

[73] Assignee: Metallurgie Hoboken-Overpelt, Antwerp, Belgium

[21] Appl. No.: 913,576

[22] Filed: Jun. 7, 1978

[30] Foreign Application Priority Data

Jun. 14, 1977 [LU] Luxembourg ..... 77538

[51] Int. Cl.[2] ..... C22B 4/04

[52] U.S. Cl. ..... 75/10 R; 75/70

[58] Field of Search ..... 75/10 R, 70, 69

[56] References Cited

U.S. PATENT DOCUMENTS

| | | | |
|---|---|---|---|
| 1,098,854 | 6/1914 | Thum | 75/70 |
| 2,330,307 | 9/1943 | O'Keefe | 75/69 |

FOREIGN PATENT DOCUMENTS

| | | |
|---|---|---|
| 1593509 | 7/1926 | United Kingdom. |
| 1809871 | 6/1931 | United Kingdom. |
| 800647 | 8/1958 | United Kingdom. |

OTHER PUBLICATIONS

Newton, Extractive Metallurgy, p. 379, (John Wiley & Sons, Inc. 1959).

*Primary Examiner*—P. D. Rosenberg
*Attorney, Agent, or Firm*—Pennie & Edmonds

[57] ABSTRACT

A process for the pyrometallurgical extraction of bismuth from a bismuth-bearing material (e.g., ores and concentrates of bismuth in the roasted or unroasted states), in an electric furnace with submerged electrodes in which the sulphur content of the charge constituted of the bismuth-bearing material is controlled so that a matte phase is produced having a bismuth content of between 3 and 20% by weight and a slag phase is produced which is separated from the matte. Under these conditions cheap fluxes (e.g., sand, limestone, iron oxide) can be used whereby the resulting slag has a relatively low corrosivity and high melting point (e.g., 1150°–12000° C.) without excessive losses of bismuth by volatilization.

10 Claims, No Drawings

PROCESS FOR EXTRACTING BISMUTH FROM A BISMUTH-BEARING MATERIAL

BACKGROUND OF THE INVENTION

This invention relates to a process for extracting bismuth from a bismuth-bearing material, in which the material is smelted in a furnace with the addition of at least one flux capable of slagging the gangue. A phase containing the bismuth is formed and separated from the slag.

As used herein, the term "bismuth-bearing material" means ores and concentrates of bismuth in the roasted or unroasted state, mixed ores and concentrates of bismuth and another metal such as copper, in the roasted or unroasted state, and bismuth-bearing metallurgical by-products such as sulphated or oxidized flue dust. These bismuth-bearing materials normally contain at least 2% by weight of bismuth.

It is known to treat oxidized bismuth concentrates by reduction smelting, mixed sulphurized-oxidized bismuth concentrates by roasting and reduction smelting, and sulphurized bismuth concentrates either by roasting and reduction smelting or by cementation smelting.

Cementation smelting is carried out in a crucible furnace in which the bismuth-bearing material is smelted, and to which is added a flux and a metal, such as iron, which has a stronger affinity for sulfur than bismuth. Three phases are formed: a lower layer constituting the metallic phase and comprising the bismuth in metallic form; an intermediate layer comprising matte containing the sulphide of said other metal; and an upper layer of slag comprising the elements of the gangue.

Reduction smelting is carried out in a reverberatory furnace or in a crucible furnace and yields a metallic phase comprising the bismuth in metallic form and a slag phase comprising the elements of the gangue.

Since bismuth is a very volatile metal, these known processes require the use of soda ash or fluor-spar as a flux in order to obtain slags with a low melting point (of about 1000° C.).

The foregoing conventional processes therefore suffer the drawbacks of requiring expensive fluxes for the smelting and yielding very corrosive sodic slags during the smelting.

Accordingly, it is an object of the present invention to provide an improved process for extracting bismuth from bismuth-bearing materials.

Another object is to provide a process for the pyrometallurgical extraction of bismuth from bismuth-bearing materials without the use of expensive fluxes and the formation of caustic sodic slags.

These and other objects of the invention and the advantages thereof can be had by reference to the following description and claims.

SUMMARY OF THE INVENTION

The foregoing objects are achieved according to the present invention by a smelting process whereby the charge of bismuth-bearing material is composed in such a way that the resulting bismuth-containing phase is a matte, the bismuth content of which is between 3 and 20% by weight, and use is made of an electric furnace with submerged electrodes.

The sulphur content of the charge to be smelted should be sufficiently high so that the bismuth content of the matte is lower than 20% by weight. It is possible, under these conditions, to utilize cheap fluxes such as sand, limestone and iron oxide, yielding slags with low corrosiveness but with a rather high melting point (i.e., between about 1150° to 1200° C.), without excessive losses of bismuth by volatilization. On the other hand, the sulphur content of the charge should not be so high that the bismuth content of the matte is less than 3% by weight; otherwise the further recovery of the bismuth from the matte would become too expensive.

In a preferred mode of carrying out the invention, the thickness of the layer of slag within the furnace is maintained at least equal to that of the layer of matte, and the matte tapped from the furnace is subjected to a cementation smelting.

The use of an electric furnace with submerged electrodes contributes largely to limit the losses of bismuth by volatilization.

DESCRIPTION OF PREFERRED EMBODIMENT

The following example is intended to illustrate, without limitation, the features and advantages of the process of the present invention for extracting bismuth from a bismuth-bearing material.

Composition of the charge: A charge of bismuth-bearing material is composed which, when smelted in an electric furnace with submerged electrodes, such smelting being neutral or slightly reducing, yields a matte collecting the bismuth to the extent of 3 to 20% by weight and a slag collecting the elements of the gangue. The specific procedure for formulating such a charge having a composition with the required sulphur content will be readily apparent to those skilled in the pyrometallurgical arts.

Procedures for regulating the sulphur content of the charge to lower such content include, for example, the addition of an oxidized concentrate or by-product, such as flue dust, to a sulphurized concentrate, and the preliminary partial roasting of the sulphurized concentrate. Procedures for raising the sulphur content of the charge include the addition of elemental sulphur and the addition of sulphurized concentrates.

Flux: Suitable fluxes for use in the present process include sand, limestone and/or iron oxide.

Conditioning of the charge: It is advantageous to agglomerate the charge to be smelted by pelletization or briquetting in order to avoid formation and mechanical carryover of dust.

Operation of the electric furnace: The operating parameters of the electric furnace are advantageously chosen so as to cause as little local overheating as possible in order to minimize the volatilization of the sulphide or other compounds of bismuth. Therefore, during operation of the electric furnace, the electrodes should be deeply immersed in the layer of slag, the thickness of this layer being advantageously at least equal to that of the layer of matte, in order to lower the energy density at the surface of the electrodes, which will generally range from 50 to 150 $W/cm^2$ of immersed electrode. The specific power of the furnace will be advantageously comprised between 80 and 150 $kW/m^2$ of bath area and the feeding rate of the charge between 200 and 350 $kg/h/m^2$ of bath area in order to allow the accumulation of a layer of cold charge on the surface of the bath.

EXAMPLE

This example illustrates the treatment of a sulphurized bismuth-bearing copper concentrate containing 28% Cu, 3% Bi and 33% S and of sulphated bismuth-bearing dust containing 15% Cu, 13% Bi and 9% S.

A charge of concentrate, dust and flux is made up with the following proportions: 45% concentrate, 45% dust and 10% sand. This charge is then pelletized and the dried pellets, containing 19.35% Cu, 7.2% Bi and 18.9% S, are fed to an electric furnace with submerged electrodes having an inner area of 0.8 $m^2$, to which a power of 98 kW is applied. The feeding rate of the pellets is 224 kg/h. This feeding rate of the pellets produces a temperature of 1180° C. in the bath. The smelted charge separates into an upper layer of slag and a lower layer of matte. Both phases may be tapped separately from the furnace, the slag through an upper tap hole and the matte through a lower tap hole. Once the furnace is filled, the total height of the bath is kept between 30 and 50 cm by tapping slag or matte at regular intervals. The tapping frequency and the tapped quantities are such that the thickness of the layer of slag never gets below 30 cm, while the thickness of the layer of matte never exceeds 20 cm.

The electric power is transmitted to the bath by two cylindrical electrodes of 130 mm diameter, dipping about 16 cm deep into the slag. Under these conditions it is observed that the voltage at the electrodes necessary to supply the power of 98 kW is about 70 V, and that with a feed rate of 224 kg/h a layer of unsmelted pellets of about 10 cm thickness accumulates on the surface of the bath.

The slag tapped from the furnace contains 0.50% Cu, 0.15% Bi, 42% $SiO_2$, 31% Fe and 0.9% S. The matte tapped from the furnace contains 42.3% Cu, 13% Bi, 18% Fe and 22% S.

The dust produced during the smelting amounts to 4.2% by weight of the pellets fed and collects only 17% of the bismuth contained in the pellets.

The recovery of the bismuth from the matte may be carried out, e.g., by cementation. This cementation, as well as the known cementation smelting of sulphurized bismuth concentrates and sulphurized mixed copper and bismuth concentrates, is based on the reaction between the bismuth sulphide and a metal which has a stronger affinity for sulphur than bismuth, e.g., iron, according to a reaction such as $Bi_2S_3 + 3\ Fe = 2\ Bi + 3\ FeS$.

However, unlike the cementation smelting of a concentrate, the cementation of smelted matte according to the present invention may be carried out at low temperature and without addition of flux, since there is nothing to be slagged.

The foregoing description and example are intended to be only illustrative of the process of the present invention. It is understood, of course, that changes and variations can be made in the above-described embodiments without departing from the scope of the invention, which is defined in the following claims.

We claim:

1. A process for extracting bismuth from a sulfur-containing bismuth-bearing charge, comprising smelting the charge in an electric furnace with submerged electrodes with addition of at least one flux capable of slagging the gangue, and tapping a matte phase containing the bismuth and a separate slag phase from the furnace, said process being further characterized in that the sulfur content of the charge is sufficiently high so that the bismuth content of the matte does not exceed 20% by weight and said sulfur content being sufficiently low so that the bismuth content of the matte is at least 3% by weight.

2. A process according to claim 1 wherein the electric power supplied to the electrodes has an energy density at the immersed surface of the electrodes of between 50 and 150 $W/cm^2$.

3. A process according to claim 1 wherein the electric power supplied to the electrodes is between 80 and 150 $kW/m^2$ of bath area.

4. A process according to claim 3 wherein the charge is introduced into the furnace at a feed rate of between 200 and 350 $kg/h/m^2$ of bath area.

5. A process according to claim 1 wherein the thickness of the layer of slag inside the furnace is kept at least equal to that of the layer of matte.

6. A process according to claim 1 wherein the charge is agglomerated before being introduced into the furnace.

7. A process according to claim 6 wherein the agglomeration is carried out by pelletization.

8. A process according to claim 6 wherein the agglomeration is carried out by briquetting.

9. A process according to claim 1 wherein the matte tapped from the furnace is subjected to cementation.

10. A process according to claim 1 wherein the charge is made up with a bismuth-bearing material containing at least 2% by weight of bismuth and the flux is sand, limestone or iron-oxide.

* * * * *

UNITED STATES PATENT AND TRADEMARK OFFICE

CERTIFICATE OF CORRECTION

PATENT NO. : 4,159,904

DATED : July 3, 1979

INVENTOR(S) : ROBERT H. MAES and LUC M. FONTAINAS

It is certified that error appears in the above-identified patent and that said Letters Patent are hereby corrected as shown below:

In the ABSTRACT, penultimate line, "12000°C." should read -- 1200° C. --

Signed and Sealed this

Ninth Day of October 1979

[SEAL]

*Attest:*

RUTH C. MASON
*Attesting Officer*

LUTRELLE F. PARKER
*Acting Commissioner of Patents and Trademarks*